US011102606B1

(12) United States Patent
Milne et al.

(10) Patent No.: US 11,102,606 B1
(45) Date of Patent: Aug. 24, 2021

(54) VIDEO COMPONENT IN 3D AUDIO

(71) Applicant: Sony Corporation, Tokyo (JP)

(72) Inventors: James R. Milne, Ramona, CA (US); Gregory Carlsson, Santee, CA (US); Steven Richman, San Diego, CA (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/851,066

(22) Filed: Apr. 16, 2020

(51) Int. Cl.
*H04S 7/00* (2006.01)

(52) U.S. Cl.
CPC ..... *H04S 7/40* (2013.01)

(58) Field of Classification Search
CPC ..... H04S 2400/11; H04S 7/30; H04S 3/002; H04S 7/40; H04R 2430/20
USPC ..... 381/17, 303, 300, 1, 18, 306, 19
See application file for complete search history.

(56) References Cited

U.S. PATENT DOCUMENTS

| | | | | |
|---|---|---|---|---|
| 8,396,576 | B2 | 3/2013 | Kraemer et al. | |
| 9,549,275 | B2 | 1/2017 | Tsingos et al. | |
| 2011/0040396 | A1* | 2/2011 | Kraemer | G10L 19/00 700/94 |
| 2016/0037280 | A1* | 2/2016 | Tsingos | H04S 5/00 381/17 |
| 2020/0244993 | A1* | 7/2020 | Schwarz | H04N 19/597 |

* cited by examiner

*Primary Examiner* — Norman Yu
(74) *Attorney, Agent, or Firm* — John L. Rogitz

(57) ABSTRACT

A visual component is added to a 3D audio stream to present on a display at the player side a visual representation of objects in the 3D audio, enabling the user to better understand what is happening in the 3D audio experience. The visual representation may include visual objects with the same location and movement in 3D space as audio objects being played.

23 Claims, 7 Drawing Sheets

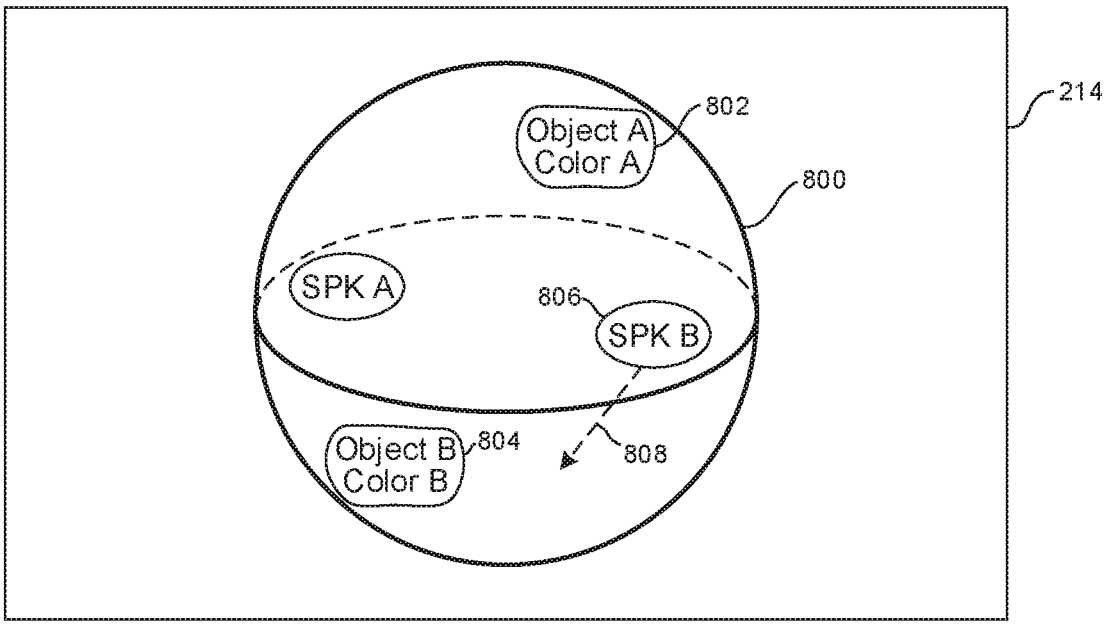
FIG. 8 Calibration
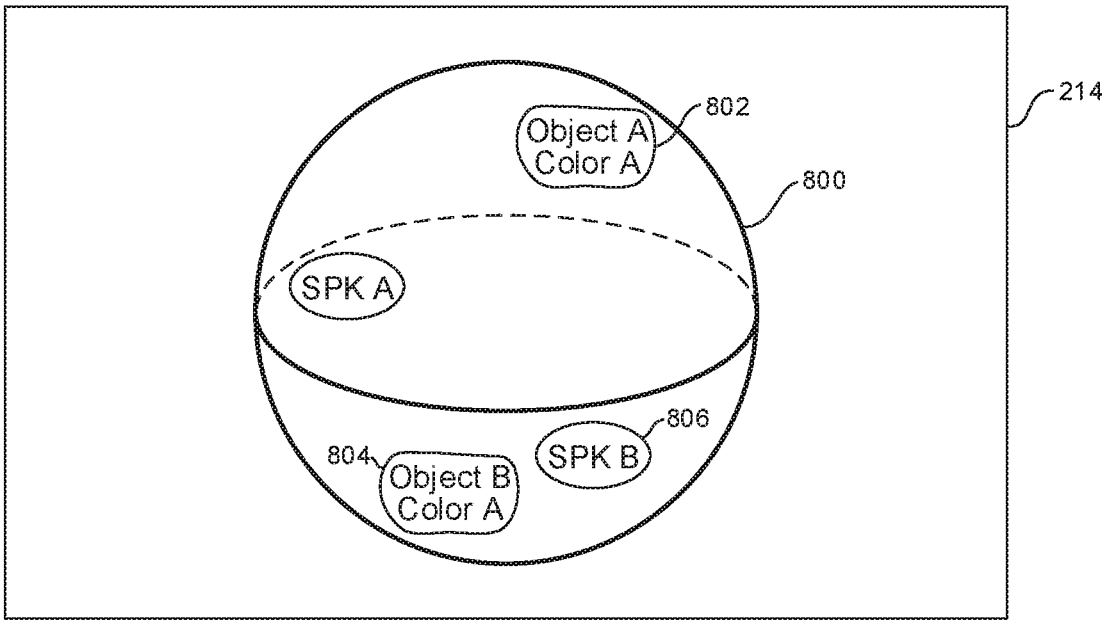
FIG. 9

VIDEO COMPONENT IN 3D AUDIO

FIELD

The present application relates generally to video components in 3D audio.

BACKGROUND

A 3D audio stream can be created by assembling various audio objects and encoding the objects into a compressed (lossless or lossy) stream. Such audio objects not only contain an audio component but can also include metadata that describes the 3D location at which the audio object is to be emulated. Other information in the metadata can include the number of channels or speakers used to render the emulated 3D space. On the playback side, the stream is decoded and rendered. If the number of playback channels doesn't equal the number of rendered channels, then a virtualization process is necessary.

SUMMARY

As understood herein, it would be advantageous to offer a visual aspect to the 3D audio experience without creating a separate video stream so as to reduce bandwidth requirements. This is because present principles recognize that listeners may encounter difficulty aurally locating all 3D objects within a stream or soundstage, particularly given that areas around the head exist where there is known confusion as to directionality, such as a circular area above the head called the Cone of Confusion. By enabling a visual representation of the location, direction, and power of the sound objects, the listener is aided in understanding the full audio presentation. Further, a visual representation of a 360° sound field can also help a person calibrate where the sound field is strongest around a room and serve as a basis for evaluating speaker placement based upon what is being heard, particularly since not every listener has a perfect ear or understands speaker placement as well as an audiophile does. This visual representation of sound objects can guide a user while listening to the music, such that as the speaker is moved or adjusted, the visual representation changes.

With the above in mind, present principles create a visual diagram of the audio objects (including location and movement) on a local playback device, without having a separate video program stream. This can be done because many of the variables are known. For example, all of the audio objects typically are present within a known normalized sphere with respective location data that reflects an object's position within or on the boundary of the sphere. Audio objects typically are not emulated to be present outside of the sphere. The location data includes 3D coordinates such as may be represented by a Cartesian coordinate system (x, y, z) or a spherical coordinate system (radius, azimuth, and elevation).

The audio objects themselves can be graphically represented by small spheres (or any desired shape). The size of the sphere may represent amplitude while the color of the sphere may represent a type of instrument or vocal (shapes and colors may be used in combination). While the colors/shapes of the objects may be fixed, the size and location of the objects within the governing sphere can be updated and displayed in real time. In other words, if an audio object moves around during a song, then the graphical representation of the object also moves.

Furthermore, the visual set of cues (for instance, in a calibration mode) can inform the user with varying colors on the spheres how close to the ideal the sound field is to be optimized for in-room listening. As the speakers get more aligned to an ideal placement, each sphere can turn to the same color and shade, contributing to a better overall guided listening experience with representative visual cues.

Accordingly, a system includes at least processor configured with instructions to receive an audio stream with at least first and second audio objects and metadata representing first and second locations in space the respective first and second audio objects are to be emulated at during playback. The instructions are further executable to play back the audio stream including the first and second audio objects according to the metadata, and to present on at least one display first and second video objects in an emulated space at respective locations corresponding to the first and second locations in space of the respective first and second audio objects according to the metadata.

The first and second video objects may include spheres. Each video object may have a size established by audio volume information in the metadata for the respective audio object. Each video object may have a color established by object type information in the metadata for the respective audio object. In non-limiting examples, the instructions may be executable to cause the first video object to move on the display responsive to movement of the first audio object in emulated 3D space.

In another aspect, a method includes receiving a 3D audio stream comprising audio objects and metadata indicating attributes of the audio objects. The method also includes using the attributes of the audio objects to add a visual component to the 3D audio stream during playback of the 3D audio stream so that the visual component is presented on a display at a player apparatus as a visual representation of an audio objects in the 3D audio stream.

In another aspect, an assembly includes at least one display, at least one speaker, and at least one processor configured for controlling the display and speakers and configured with instructions to play audio objects received in signals that include audio objects and metadata but not video objects on the at least one speaker according to the metadata. The instructions also are executable to present video objects on the at least one display consistent with the metadata describing the audio objects.

The details of the present application, both as to its structure and operation, can be best understood in reference to the accompanying drawings, in which like reference numerals refer to like parts, and in which:

BRIEF DESCRIPTION OF THE DRAWINGS

FIGS. 8 and 9 illustrate example screen shots of calibration mode presentation;

DETAILED DESCRIPTION

Figure 1:
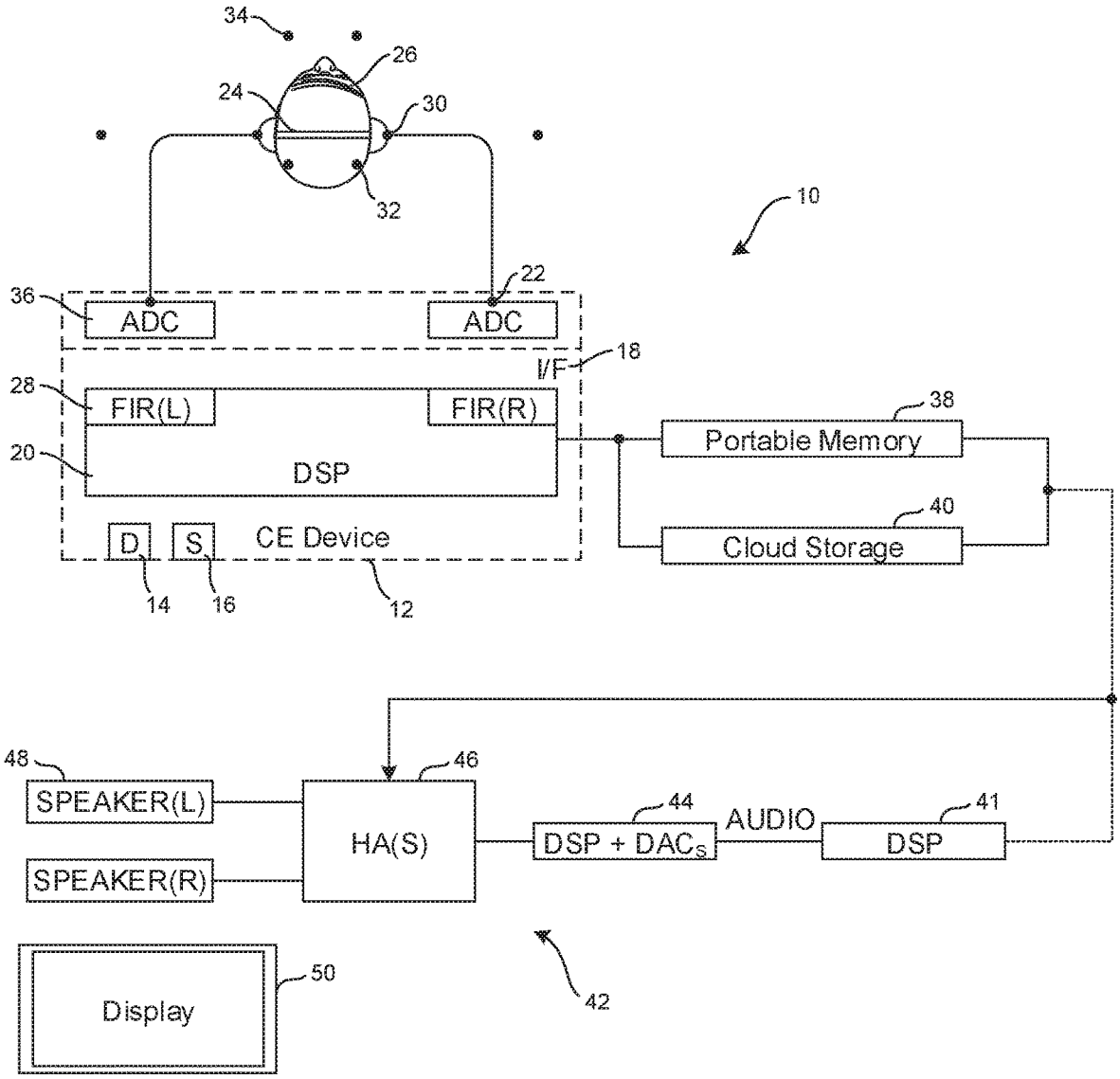
FIG. 1 is a block diagram of an example playback system.

This disclosure accordingly relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general-purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general-purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is an example of a device that may be configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more displays 14 such as touch-enabled displays, and one or more speakers 16 for outputting audio in accordance with present principles. The example CE device 12 may also include one or more network interfaces 18 for communication over at least one network such as the Internet, a WAN, a LAN, etc. under control of one or more processors 20 such as but not limited to a DSP. It is to be understood that the processor 20 controls the CE device 12 to undertake present principles, including the other elements of the CE device 12 described herein. Furthermore, note the network interface 18 may be, e.g., a wired or wireless modem or router, or other appropriate interface such as, e.g., a wireless telephony transceiver, Wi-Fi transceiver, etc.

In addition, to the foregoing, the CE device 12 may also include one or more input ports 22 such as, e.g., a USB port to physically connect (e.g. using a wired connection) to another CE device and/or a headphone 24 that can be worn by a person 26. The CE device 12 may further include one or more computer memories 28 such as disk-based or solid-state storage that are not transitory signals on which is stored files or other data structures. The CE device 12 may receive, via the ports 22 or wireless links via the interface 18 signals from first microphones 30 in the earpiece of the headphones 24, second microphones 32 in the ears of the person 26, and third microphones 34 external to the headphones and person, although only the headphone microphones may be provided in some embodiments. The signals from the microphones 30, 32, 34 may be digitized by one or more analog to digital converters (ADC) 36, which may be implemented by the CE device 12 as shown or externally to the CE device.

HRTF calibration files that are personalized to the person 26 wearing the calibration headphones may be used in implementing 3D audio. A HRTF calibration file typically includes at least one and more typically left ear and right ear FIR filters, each of which typically includes multiple taps, with each tap being associated with a respective coefficient. By convoluting an audio stream with a FIR filter, a modified audio stream is produced which is perceived by a listener to come not from, e.g., headphone speakers adjacent the ears of the listener but rather from relatively afar in 3D space, as sound would come from an orchestra for example on a stage that the listener is in front of.

HRTF files and other data may be stored on a portable memory 38 and/or cloud storage 40 (typically separate devices from the CE device 12 in communication therewith, as indicated by the dashed line), with the person 26 being given the portable memory 38 or access to the cloud storage 40 so as to be able to load (as indicated by the dashed line) his personalized HRTF into a receiver such as a digital signal processor (DSP) 41 of playback device 42 of the end user. A playback device may include one or more additional processors such as a second digital signal processor (DSP) with digital to analog converters (DACs) 44 that digitize audio streams such as stereo audio or multi-channel (greater than two track) audio, convoluting the audio with the HRTF information on the memory 38 or downloaded from cloud storage. This may occur in one or more headphone amplifiers 46 which output audio to at least two speakers 48, which may be speakers of the headphones 24 that were used to generate the HRTF files from the test tones. U.S. Pat. No. 8,503,682, owned by the present assignee and incorporated herein by reference, describes a method for convoluting HRTF onto audio signals. Note that the second DSP can implement the FIR filters that are originally established by the DSP 20 of the CE device 12, which may be the same DSP used for playback or a different DSP as shown in the example of FIG. 1. Note further that the playback device 42 may or may not be a CE device and may include its own display 50.

In some implementations, HRTF files may be generated by applying a finite element method (FEM), finite difference method (FDM), finite volume method, and/or another numerical method, using 3D models to set boundary conditions.

U.S. Pat. No. 9,854,362 is incorporated herein by reference and describes details of finite impulse response (FIR) filters as well as techniques for inputting or sensing speaker locations. U.S. Pat. No. 10,003,905, incorporated herein by reference, describes techniques for generating head related transfer functions (HRTF) using microphones.

Figure 2:
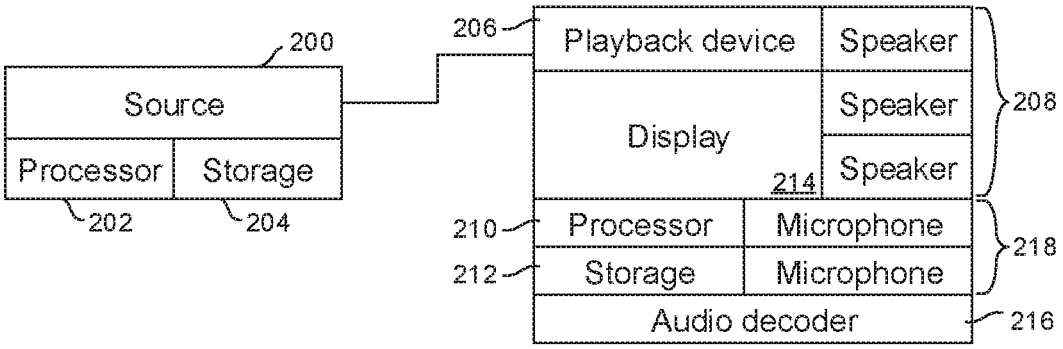
FIG. 2 is a block diagram of an example audio source sending 3D audio to an audio playback apparatus.

FIG. 2 illustrates a source 200 of audio may include one or more processor 202 accessing one or more storage media 204 to generate audio streams or signals to send to a playback device 206. The audio may be three-dimensional (3D) audio and may include both audio objects along with metadata describing attributes of the audio objects, such as playback volume for the object, type of audio object, and location of audio object in 3D space. The audio stream or signals need not include video objects.

The playback device 206 may be implemented by any device described herein for playing the audio objects on one or more audio speakers 208 under control of one or more processors 210 accessing one or more computer storage media 212. The playback device 206 also may include one or more visual displays 214 such as a video display or monitor that may be integrated with the speakers 208 or may be separate therefrom, e.g., the speakers 208 may be surround sound audio and the display 214 may be a TV display. One or more audio decoders 216 also may be provided as may one or more microphones 218.

Figure 3:
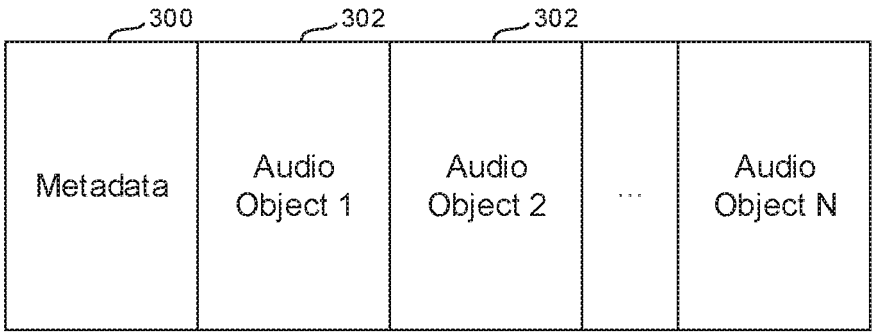
FIG. 3 illustrates an example 3D audio stream with embedded visual objects.

FIG. 3 illustrates a 3D audio stream with metadata 300 and plural audio objects 302, but no video objects. In other embodiments video objects may be included in the audio stream.

Figure 4:
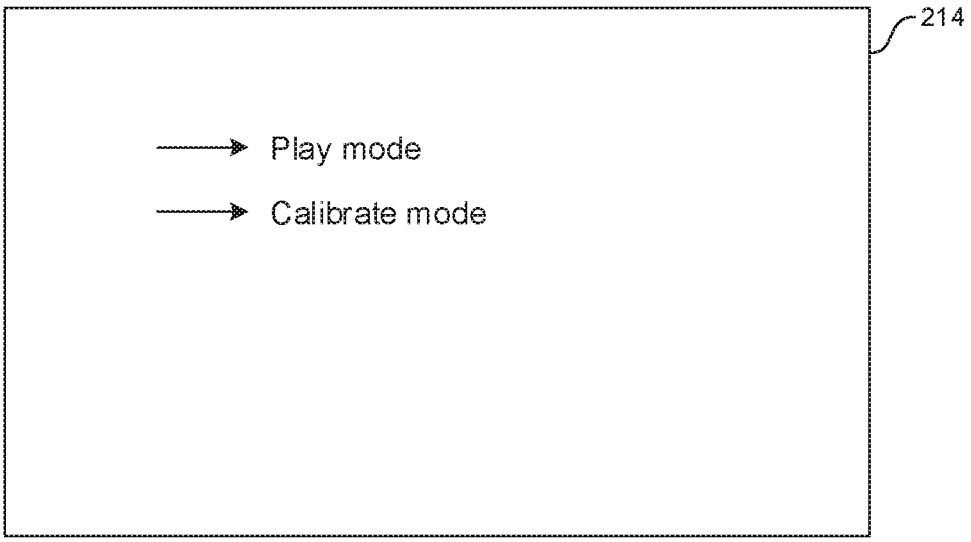
FIG. 4 illustrates an example screen shot of an example user interface (UI) for selecting between play mode and calibrate mode.

FIG. 4 illustrates a user interface (UI) that may be presented on a display such as the visual display 214 shown in FIG. 2. The UI may include a first selector 400 for selecting a play mode and a second selector 402 for selecting a calibrate mode, discussed further below in reference to FIG. 12.

Figure 5:
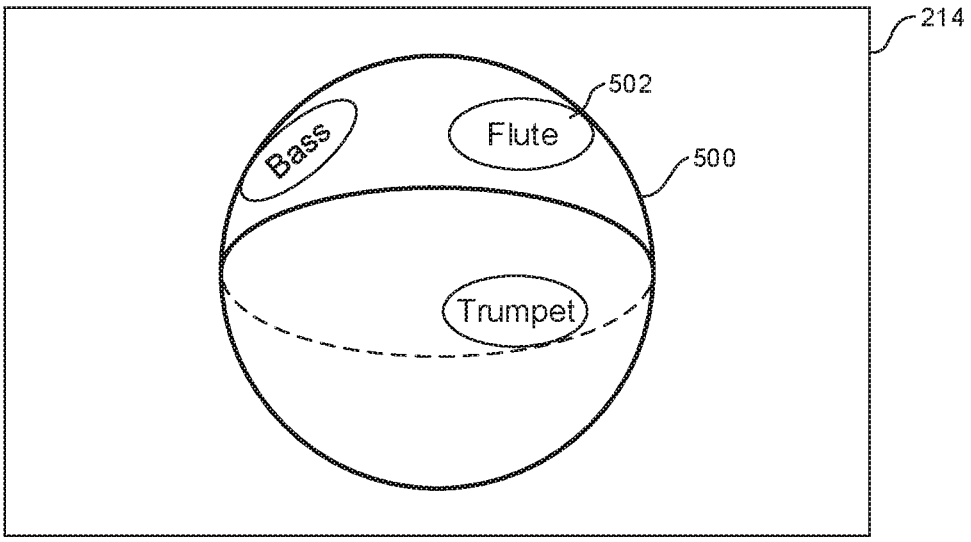
FIG. 5 illustrates an example screen shot of a visual display presenting visual objects.

FIG. 5 illustrates principles discussed in greater detail elsewhere herein for the play mode. As shown, a representation 500 of 3D space (in the example shown, shown as a sphere) may be presented on a display such as the display 214 shown in FIG. 2. As also shown, various video objects 502 are shown on or within the sphere. The video objects 502 correspond to respective audio objects in the audio stream of FIG. 3, and may be configured as polygons, other shapes, or as shown spheres the sizes of which may be established by the playback device responsive to respective volumes at which the respective audio objects are to be played.

One or more visual attributes other than size also may be established for the video objects 502. For example, each video object 502 may have a color that is selected by the user to correspond to a particular audio object type or that is correlated to an audio object type by the playback processor. In the example, the video objects represent a flute, a trumpet, and a bass, and each video object may have a color keyed to the type of instrument of the respective audio object.

Figure 6:
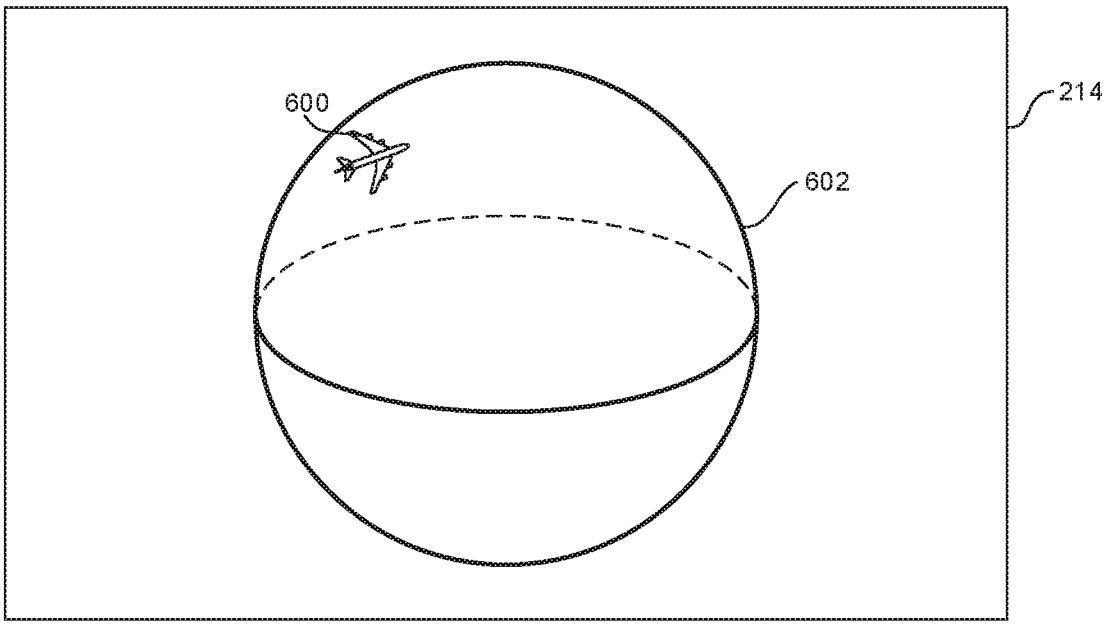
FIGS. 6 and 7 illustrate example screen shots of a video object moving in 3D visual space as the underlying audio object moves in 3D audio space.
Figure 7:
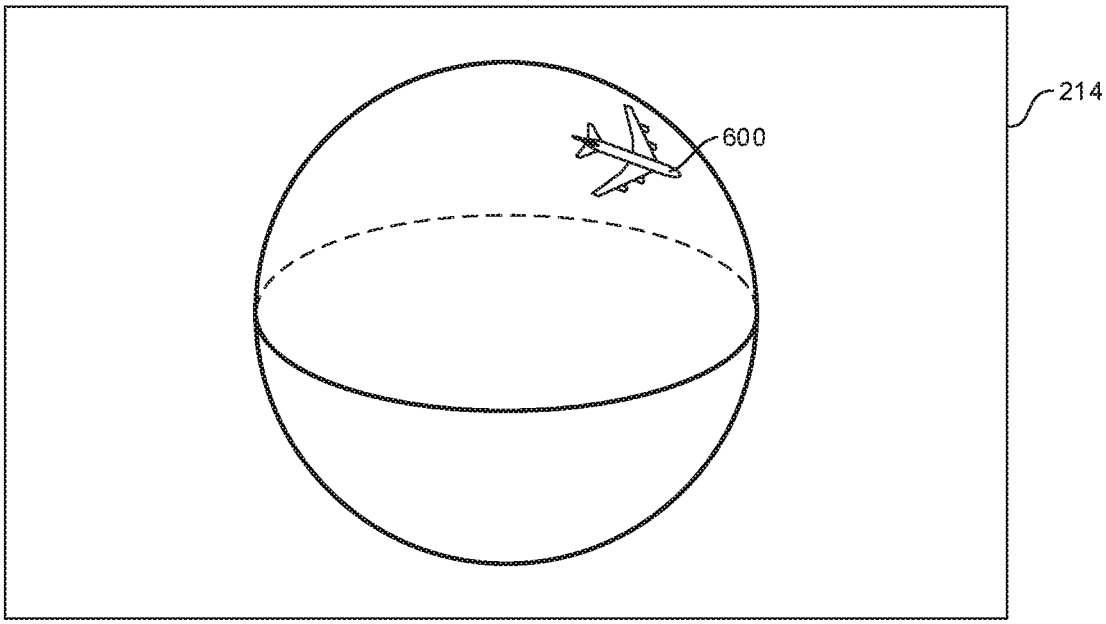

FIGS. 6 and 7 show an alternate embodiment in which a video object 600 is presented on a representation 602 of 3D space with a visual configuration matching the audio object type, in the example shown, a plane. As the audio object moves through 3D audio space over time as indicated by the metadata, the video object 600 moves from a first location shown in FIG. 6 toward the second location shown in FIG. 7 over time to match the movement of the audio object as indicated in the metadata.

FIGS. 8 and 9 illustrate that in the calibrate mode, a display such as the display 214 shown in FIG. 2 may present a representation 800 of 3D space along with video objects, in the example shown, objects 802, 804 each having a size and color established according to audio metadata. Additionally, representations 806 of speakers in the playback system appear on the representation 800 of 3D space in locations corresponding to their real-world locations using, for example, any of the techniques described in U.S. Pat. No. 9,854,362. This helps the user understand speaker location in relation to audio object location that may be presented on the speakers.

If desired, a visual indication 808 may be presented indicating to the user a direction and a distance a particular speaker should be moved to optimize 3D audio playback. The optimum speaker layout may be determined using feedback from the microphones 218 shown in FIG. 2, specifically by determining, using microphone signals, whether locations of audio objects in 3D audio space match the locations indicated in the metadata, and if not, calculating new locations for one or more of the speakers in the playback system by correlating differences in detected and demanded audio locations to speaker location-based delays. FIG. 9 indicates that the color of one audio object 804 may change to match the color of the other audio object 802 when an optimum (within a range) speaker layout is achieved.

Figure 10:
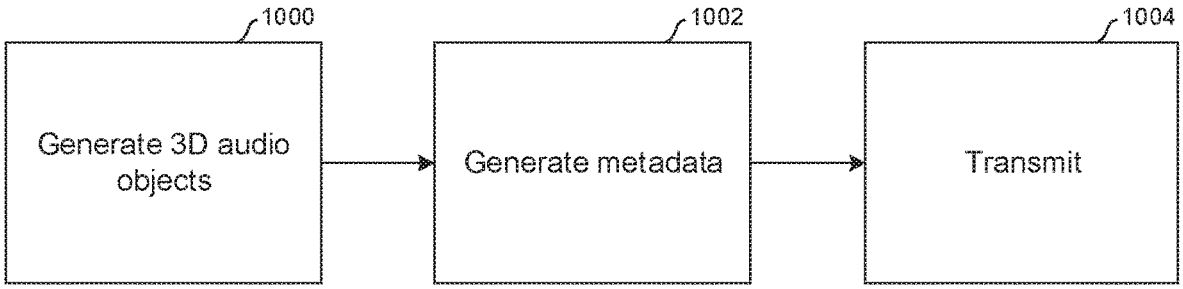
FIG. 10 illustrates example logic in example flow chart format of the audio source.

FIG. 10 illustrates logic that may be executed by the audio source 200 shown in FIG. 2. Commencing at block 1000, 3D audio objects are generated and metadata describing those objects is generated at block 1002. The audio objects and metadata are transmitted in a 3D audio stream at block 1004 to the playback device 206 shown in FIG. 2.

Figure 11:
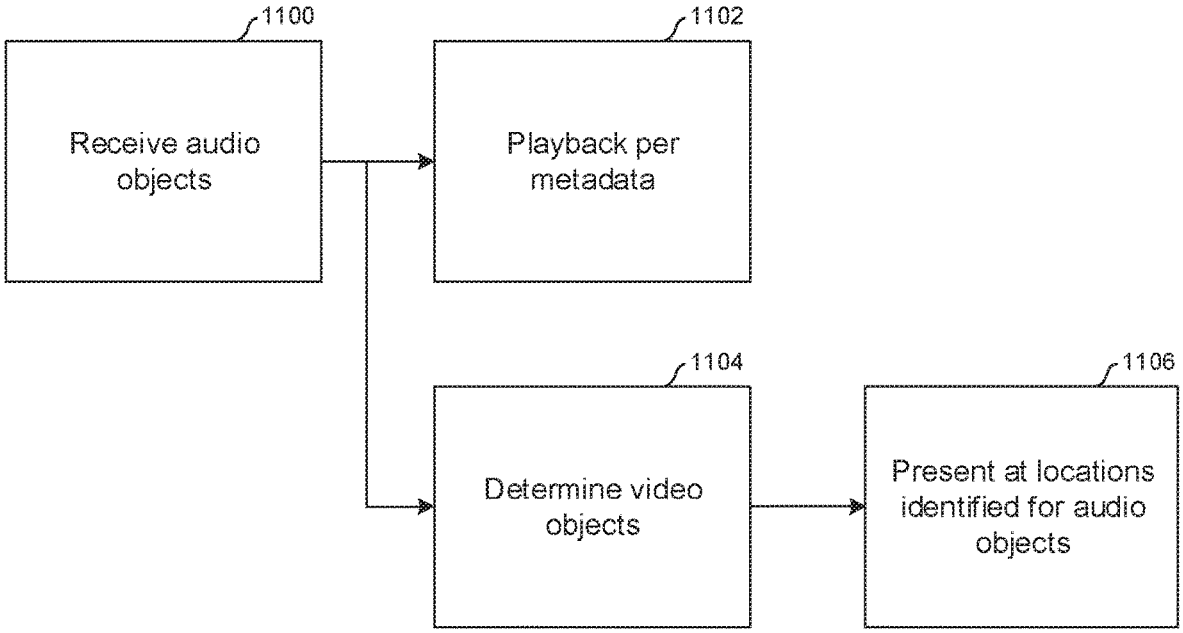
FIG. 11 illustrates example logic in example flow chart format of the audio playback apparatus.

FIG. 11 illustrates logic that may be executed by the playback device 206 shown in FIG. 2. Commencing at block 1100, the audio objects are received in the audio stream, decoded as appropriate using, e.g., the audio decoder 216 shown in FIG. 2. The metadata describing the audio objects, including playback audio volume, audio object type, and audio object location in emulated 3D audio space is accessed and the audio objects played on the speakers 208 according to the metadata at block 1102.

Also, as indicated at block 1104, video objects are determined for one or more the audio objects. In some embodiments each audio object may have a corresponding video object. In other embodiments only a subset of audio objects may have corresponding video objects. For example, only the "N" loudest audio objects may have corresponding video objects, which may be labeled, or unlabeled spheres or other shapes as described above.

Moving to block 1106, the video objects are presented on, e.g., the display 214 shown in FIG. 2 in accordance with the audio metadata. That is, the video objects are presented in the same locations of emulated 3D space as the audio metadata indicates the respective audio objects are to be presented on the audio speakers, with size and other visual attributes of the video objects being established consistent with principles herein.

Figure 12:
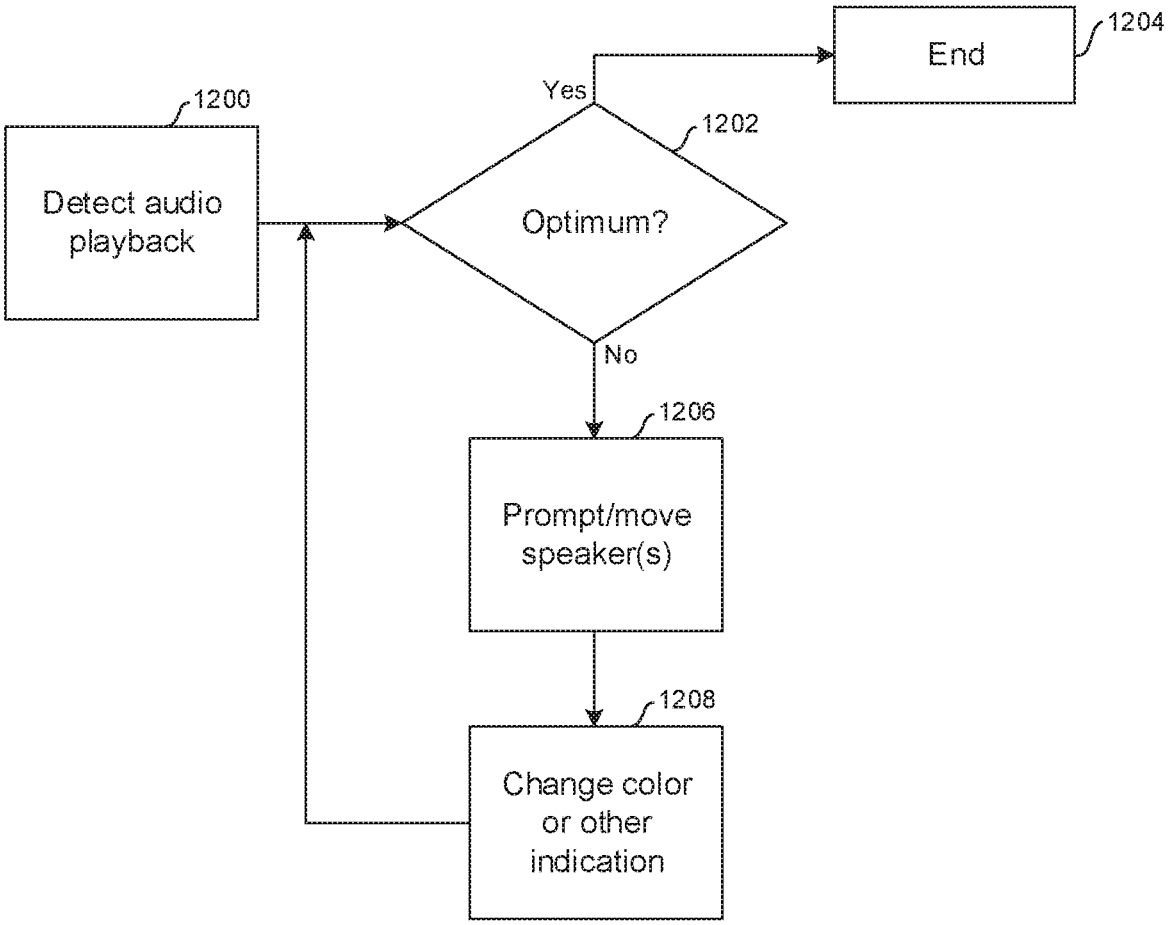
FIG. 12 illustrates example logic in example flow chart format of the calibration mode.

FIG. 12 further illustrates an example calibration process. Audio playback during calibration mode is detected, e.g., using the microphones 218 shown in FIG. 2, at block 1200. Moving to decision diamond 202, it is determined whether the speaker location layout is optimum, and if so, the logic ends at state 1204. Otherwise, the logic moves to block 1206 to present a prompt to move one or more of the physical speakers. If desired, the color or size or other visual attribute of one or more of the video objects may change at block 1208 responsive to movement of a speaker toward a more optimum location. The logic can then loop back to decision diamond 1202.

In addition to the above, audio objects in a 3D space can be updated dynamically as the playback of an audio file or live performance is rendered to the speakers or headphones. The size and color of the corresponding video objects help to inform the user of the location of the audio objects and their sound pressure levels and nature of their sound or tonal components, such as different colors representing different instruments. This data can be derived from a quick calibration of speaker placement and sound stage initially plus evaluating the sound elements (frequency, amplitude, latency, phase, object direction) of the sound stream being decoded and rendered.

The metadata also can be used to align the speakers as discussed above. This leads to the natural evolution of a live stream optimizer that allows for dynamic replacement or movement of speakers in a room or around the home, or the addition of speakers into a sound stage such that the visual differences between what was there before and was added can be compared. This comparison can be visualized as a difference map of the difference between the objects rendered before and after the addition and a third rendering showing how the sound stage was improved. Thus present principles help to visually represent a 3D audio space to the listener, help to locate and calibrate speakers in a sound stage for ideal placement, and visually represent the improvement in the audio experience by taking the difference between the pre and post calibration speaker placement, or pre and post speaker live rendering or playback such that the listener knows how much improvement has been made. This subtraction mode yields a visual display of how effectively the speakers were rearranged without the clutter of simultaneously showing all the objects in their full rendering mode. Only the soundstage improvement visual need be rendered.

The above effectively produces a scorecard that can be established for giving the listener a percentage optimized sound environment. The scorecard can be broken down by objects or given a total score. The soundstage optimization score is comprised of the metadata that is used to create the visual objects listed as a graph or a numerical total. Each element can have its subtotal. These are additional ways of providing a listener a way to create histograms of audio performance along with speaker configurations and to store them. That way if a room is changed by moving speakers, it can be quickly redone, by calling up the highest-level score for the appropriate speaker layout the listener is intending to create in a room. This memory driven aspect promotes creative ways to display sound in a visual space to give clues to the nature of the music and also to provide feedback on sound optimization techniques.

Additionally, sound optimization may depend on the listener's objective, e.g., optimizing sound playback for the hearing impaired in which optimization seeks to account for how a person hears or lacks hearing in certain portions of the hearing spectrum. This personalization component would give the listener a personalized visual display of targeted sound objects that are hard to hear, or that are out of balance (vocals too loud or background to low), such that the incongruities in HRTF for the accessibility community for any hearing impaired person can be visually represented. This technique allows for hearing impaired to know their own personal soundstage is optimized taking into account their own HRTF or the individual audio adjustments used for example with or without their hearing aid. That way the hearing-impaired listener can have a hearing aid mode, and a non-hearing aid mode for listening.

Sound personalization can be available using the feedback mechanism described herein in that sound is virtualized as visual objects and turned into a live, dynamic information translator. In this way a 3D audio object can be isolated and listened to exclusively with the other objects turned off. This a user to adjust sound equalizer settings to his own personal taste by isolating a sound object, establishing audio settings as desired, with a respective video object being rendered alone on the display.

While the particular embodiments are herein shown and described in detail, it is to be understood that the subject matter which is encompassed by the present invention is limited only by the claims.

What is claimed is:

1. A system comprising:

at least processor configured with instructions to:

receive an audio stream comprising at least first and second audio objects and metadata representing first and second locations in space the respective first and second audio objects are to be emulated at during playback;

play back the audio stream including the first and second audio objects according to the metadata;

present on at least one display first and second video objects in an emulated space at respective locations corresponding to the first and second locations in space of the respective first and second audio objects according to the metadata; and cause the first video object to move on the display responsive to movement of the first audio object in emulated 3D space.

2. The system of claim 1, comprising at least one speaker on which the audio objects are played back.

3. The system of claim 2, comprising the at least one display.

4. The system of claim 1, wherein the first and second video objects comprise spheres.

5. The system of claim 1, wherein each video object comprises a size established by volume information in the metadata for the respective audio object.

6. The system of claim 1, wherein each video object comprises a color established by object type information in the metadata for the respective audio object.

7. The system of claim 1, wherein the instructions are executable to:

present on the at least one display the first and second video objects in an emulated space based on the metadata in the audio stream representing first and second locations in space the respective first and second audio objects are to be emulated at during playback.

8. The system of claim 1, wherein the instructions are executable to:

present on the display a visual indication indicating a direction and a distance a first speaker should be moved to optimize audio playback.

9. The system of claim 8, wherein the instructions are executable to:

change a color of one at least one object responsive to an optimum speaker layout being achieved.

10. A method, comprising:

receiving an audio stream comprising at least first and second audio objects and metadata representing first and second locations in space the respective first and second audio objects are to be emulated at during playback;

playing back the audio stream including the first and second audio objects according to the metadata;

presenting on at least one display first and second video objects in an emulated space at respective locations corresponding to the first and second locations in space of the respective first and second audio objects according to the metadata; and causing the first video object to move on the display responsive to movement of the first audio object in emulated 3D space.

11. The method of claim 10, wherein the first and second video objects comprise spheres.

12. The method of claim 10, comprising establishing a size of each video object based on volume information in the metadata for the respective audio object.

13. The method of claim 10, comprising establishing a color of each video object based on object type information in the metadata for the respective audio object.

14. The method of claim 10, comprising:

presenting on the at least one display the first and second video objects in an emulated space based on the metadata in the audio stream representing first and second locations in space the respective first and second audio objects are to be emulated at during playback.

15. The method of claim 10, comprising:

presenting on the display a visual indication indicating a direction and a distance a first speaker should be moved to optimize audio playback.

16. The method of claim 15, comprising:

changing a color of one at least one object responsive to an optimum speaker layout being achieved.

17. An apparatus comprising:

at least one video display;

at least one audio speaker; and at least processor configured with instructions to:

receive an audio stream comprising at least first and second audio objects and metadata representing first and second locations in space the respective first and second audio objects are to be emulated at during playback;

play back, on the speaker, the audio stream including the first and second audio objects according to the metadata;

present, on the display, first and second video objects in an emulated space at respective locations corresponding to the first and second locations in space of the respective first and second audio objects according to the metadata; and cause the first video object to move on the display responsive to movement of the first audio object in emulated 3D space.

18. The apparatus of claim 17, wherein the first and second video objects comprise spheres.

19. The apparatus of claim 17, wherein each video object comprises a size established by volume information in the metadata for the respective audio object.

20. The apparatus of claim 17, wherein each video object comprises a color established by object type information in the metadata for the respective audio object.

21. The apparatus of claim 17, wherein the instructions are executable to:

present on the at least one display the first and second video objects in an emulated space based on the metadata in the audio stream representing first and second locations in space the respective first and second audio objects are to be emulated at during playback.

22. The apparatus of claim 17, wherein the instructions are executable to:

present on the display a visual indication indicating a direction and a distance a first speaker should be moved to optimize audio playback.

23. The apparatus of claim 22, wherein the instructions are executable to:

change a color of one at least one object responsive to an optimum speaker layout being achieved.

* * * * *